US005868609A

United States Patent [19]

Aaron et al.

[11] Patent Number: 5,868,609

[45] Date of Patent: Feb. 9, 1999

[54] WAFER CARRIER ROTATING HEAD ASSEMBLY FOR CHEMICAL-MECHANICAL POLISHING APPARATUS

[75] Inventors: Jack Aaron, Tustin; William Yueh, Irvine, both of Calif.

[73] Assignee: I C MIC-Process, Inc., Santa Ana, Calif.

[21] Appl. No.: 840,250

[22] Filed: Apr. 14, 1997

[51] Int. Cl.[6] ..... B24B 7/00

[52] U.S. Cl. ..... 451/285; 451/288; 451/397; 451/398

[58] Field of Search ..... 451/41, 285, 287, 451/288, 397, 398

[56] References Cited

U.S. PATENT DOCUMENTS 5,449,316 9/1995 Strasbaugh ..... 451/287
5,624,299 4/1997 Shendon ..... 451/285
5,626,509 5/1997 Hayashi ..... 451/285
5,651,724 7/1997 Kimura et al. ..... 451/285

*Primary Examiner*—Eileen P. Morgan
*Attorney, Agent, or Firm*—Herbert M. Shapiro

[57] ABSTRACT

A chemical-mechanical polishing apparatus includes a wafer carrier with a very low center of gravity which allows pressure to be applied evenly on a wafer being polished. The wafer carrier includes top, center, and bottom mating subassemblies with only the center and bottom subassembly or wafer holder actually rotating. The bottom of the central subassembly and the top of the bottom subassemblies are shaped as negative and positive, mating truncated pyramids with a downward extension at the center axis of the central subassembly which terminates in a ball in a recess in the top of the lower subassembly. The ball is positioned as low as possible to provide a very low center of gravity to ensure even pressure distribution over a wafer being polished. The truncated pyramidal shapes are to provide a geometry which exhibits a rigid structure with incrementally decreasing mass with distance from the central axis.

13 Claims, 5 Drawing Sheets

WAFER CARRIER ROTATING HEAD ASSEMBLY FOR CHEMICAL-MECHANICAL POLISHING APPARATUS

FIELD OF THE INVENTION

This invention relates to chemical mechanical polishing apparatus and more particularly to the wafer carrier which holds the wafer to be polished by such apparatus.

BACKGROUND OF THE INVENTION

Chemical-mechanical polishing (CMP) is used for wafer surface layer planarization in an ever widening number of applications. The proliferation of CMP apparatus in the manufacturing environment has been accompanied by industry pressure to increase throughput and to reduce costs.

In the CMP process a wafer carrier urges a wafer against a rotating platen which carries a polishing pad. One way to increase throughput is to increase the pressure on the wafer. At present, such apparatus allows a pressure of about 10 pounds per square inch on the wafer. A significantly increased pressure per square inch is desirable though to obtain faster removal rates. But the commercially available apparatus is not capable of permitting such pressures without having unwanted effects on wafer uniformity.

A typical wafer carrier assembly is shown in, for example, U.S. Pat. No. 5,329,732 issued Jul. 19, 1994. The assembly comprises three subassemblies: The first subassembly is at the top of the wafer carrier and is attached along its central axis to the actuator which raises, lowers, and rotates the wafer carrier. This first assembly has an enlarged diameter lower section. The second subassembly has a top portion which has a C shaped cross section which engages the enlarged diameter lower section of the first assembly. The second (or center) subassembly is spring-loaded on the top of the enlarged diameter section and includes ball bearings which permit the second assembly to cant with respect to the first assembly.

The third (or bottom) subassembly comprises the wafer holder and is fixedly connected to the bottom of the second subassembly. Some CMP apparatus includes a wafer guard inside of a guard ring which encompasses the wafer being polished.

In all presently available CMP apparatus, all those subassemblies rotate and are driven from the top along the central axis. An increase in pressure on a wafer in such apparatus causes the wafer to pull to one side and pick up on the other side because the apparatus does not permit the pressure to be distributed evenly. It is difficult to achieve evenly distributed pressure in prior art CMP apparatus.

BRIEF DESCRIPTION OF THE INVENTION

The present invention is based on the recognition that the reason that pressure is not distributed evenly on a wafer being polished by presently available CMP apparatus is that the center of gravity of the apparatus is too far away from the wafer and the center of rotation of the wafer carrier is too far away from the central axis of the apparatus. Consequently, pressure in prior art wafer polishers causes a moment which tends to pick up one side of the wafer.

In accordance with the principles of this invention, a CMP wafer carrier also comprises three subassemblies. But the bottom of the second subassembly and the top of the third subassemblies are shaped as mating truncated pyramids pivoting on a ball positioned at a central axis thus providing a very low pivot point. Only the second and third subassembly rotates herein with a center of gravity at the center of the ball. Thus, the rotation (gimbal) center and the wafer center of gravity coincide perfectly and will not shift during high speed rotation.

DETAILED DESCRIPTION OF AN ILLUSTRATIVE EMBODIMENT OF THE INVENTION

Figure 1:
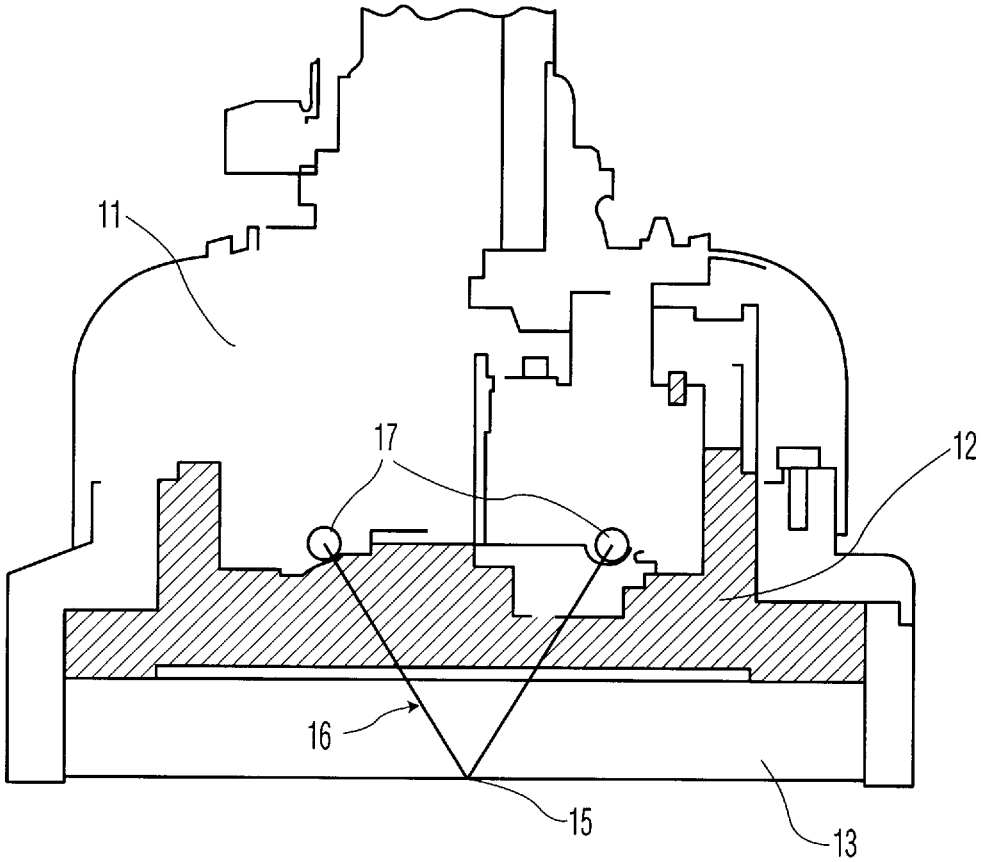
FIG. 1 PRIOR ART
FIG. 1 is a cross sectional view of a representative prior art wafer carrier.

FIG. 1 shows a cross section of a prior art CMP apparatus. The apparatus comprises top, center and bottom subassemblies 11, 12, and 13 respectively which are connected to one another by screws and which are rotated about a central axis in the entirety. The apparatus not only is rotated from the top of the assemblies but also pressure is introduced downwards along the central axis. The apparatus is characterized by a moment represented by a line 16 and has a center of gravity which is relatively high at a level at which ball bearings 17 are located. Ball bearings 17 permit the slight centering movement required between the center and the bottom subassemblies when pressure is applied.

Figure 2:
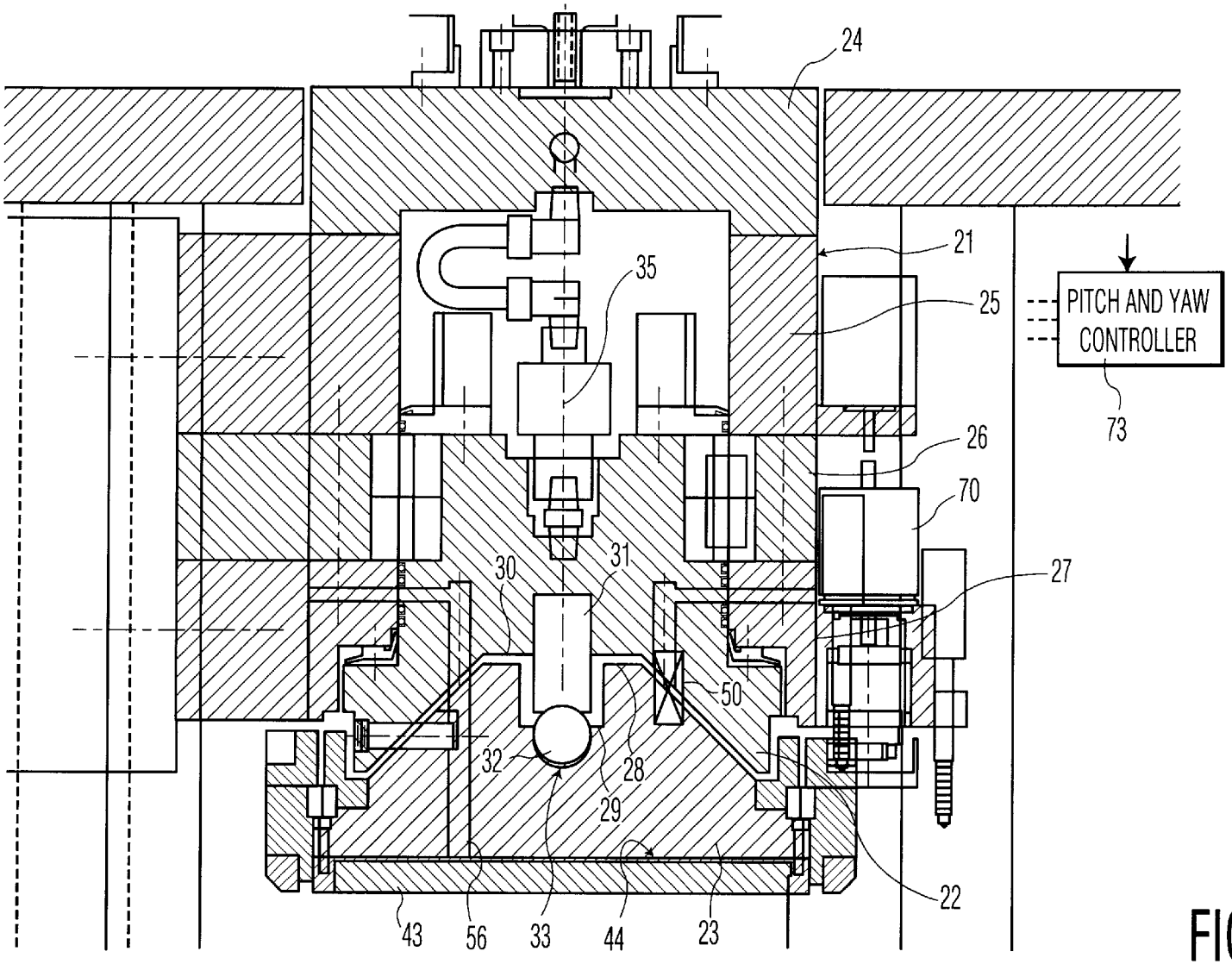
FIG. 2 is a cross section of a wafer carrier in accordance with the principles of this invention.

FIG. 2 is a cross section of an illustrative embodiment of a CMP apparatus in accordance with the principles of this invention. Again the apparatus comprises top, center and bottom subassemblies 21, 22, and 23. The top subassembly comprises four components 24, 25, 26, and 27. The center and the lower subassemblies are (each) single components.

The apparatus of FIG. 2 is characterized by a geometry which provides a bottom subassembly with a mass which lessens with distance from the central axis of the apparatus and provides for a very low center of gravity for the apparatus. Specifically, the bottom subassembly (23) has a top surface which has the shape of a truncated pyramid with a recess 29 extending downward as shown. Subassembly 22 has a mating bottom surface 30 which is an inverted truncated pyramid which is a negative to the (positive) shape of top surface 28.

Importantly, subassembly 22 has a downward extension 31 which protrudes into recess 29 terminating in a ball 32. The bottom of recess 29 has a spherical shape to receive ball 32 in a slip fit relationship. But, the spherical shape is slightly elongated at bottom at 33, to permit compliance of subassembly 22 with subassembly 23 when pressure is first initiated downwards along central axis 35.

The pyramidal shapes of the subassembly surfaces provides for the mass center of the bottom subassembly to decrease with distance from central axis 35. The recess (29) and extension 31 with ball 32 provides for a center of gravity at the center of the ball. The result of such a geometry is that a virtually non existent moment is generated during rotation when downward pressure is applied to the apparatus. Consequently, significantly elevated pressure can be applied to a wafer being polished by such apparatus without necessitating unwanted increase in the overall mass of the apparatus. The pressure also is evenly distributed over the wafer because of the rigid pyramidal structure of the bottom subassembly 23 which is made of 370 stainless steel material.

In a clear departure from prior art apparatus, only the center and bottom subassemblies rotate in accordance with the principles of this invention. That is to say, up and down movement of the apparatus which moves a wafer against a polishing pad on a juxtaposed platen is applied along the central axis. But the apparatus is not rotated by a rotating shaft along the central axis.

Figure 3:
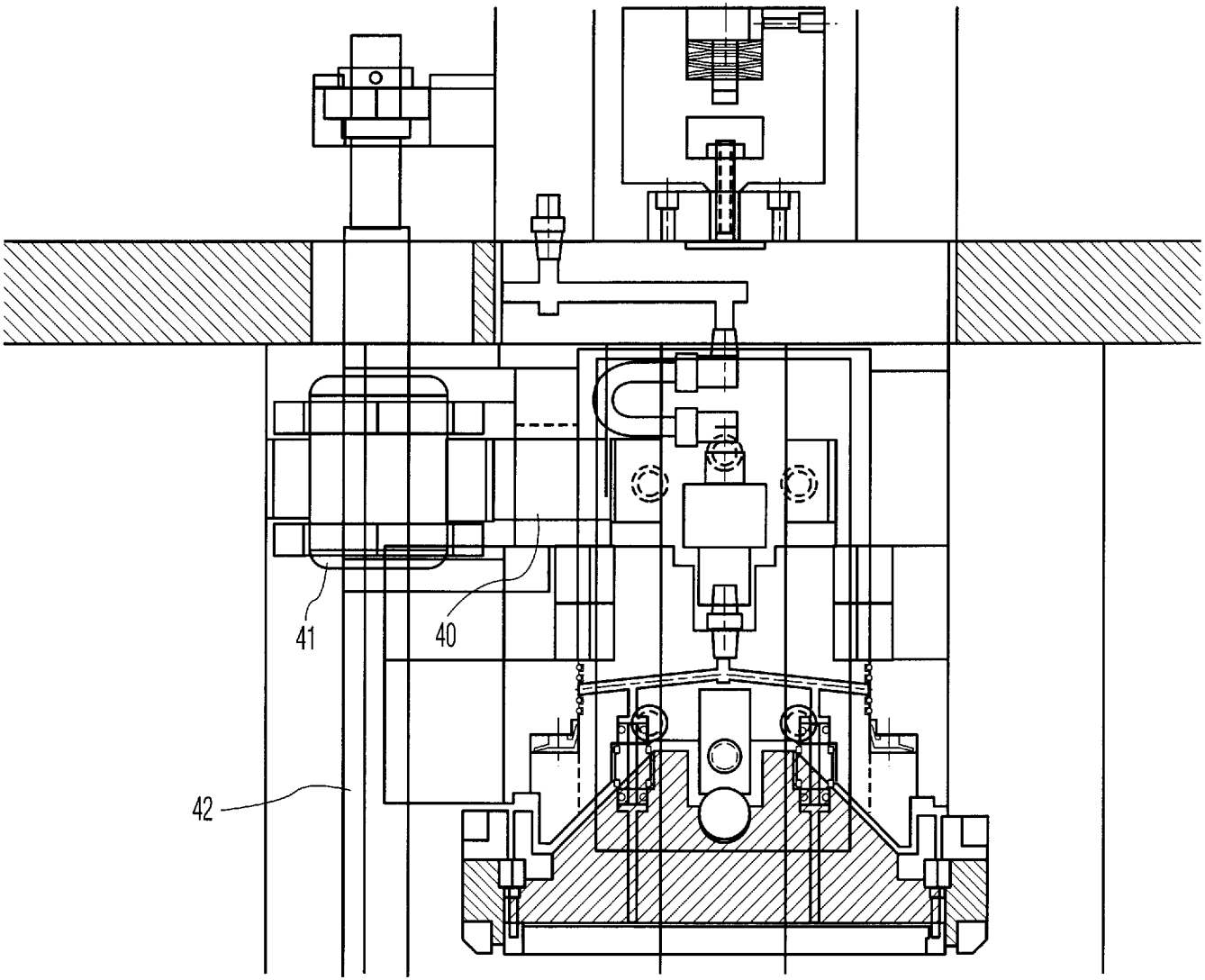
FIG. 3 is a cross sectional view of a portion of the wafer carrier of FIG. 2.

Instead, only the center and lower subassemblies are driven by a belt 40 driven by motor 41 as shown in FIG. 3. Motor 41 is of a configuration to move up and down along a shaft 42 as the apparatus is moved downward to move a wafer into position for polishing.

Figure 4:
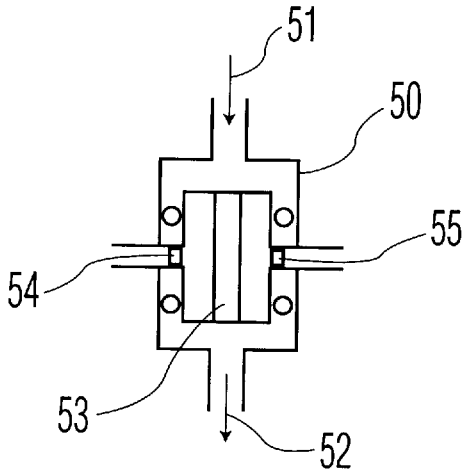
FIG. 4 is a cross section of an O-ring assembly for providing vacuum or water connection between the central and lower subassemblies of FIGS. 4 and 5.

A wafer 43 is secured to the bottom surface 44 of bottom subassembly 23 by a vacuum as is typical of prior art apparatus also. The geometry of FIG. 2 provides for bringing that vacuum across the interface between subassemblies 22 and 23. FIG. 4 is a schematic representation of a compliant sealed O-ring assembly represented by rectangle 50 in FIG. 2. The assembly is connected between a vacuum inlet (in 22) represented by arrow 51 and a vacuum outlet (in 23) represented by arrow 52. The assembly has a central conduit 53 and first and second O-rings for sealing the assembly. The assembly is fixed in place by pins 54 and 55. This same assembly also may be used to supply water to bottom subassembly 23 if cooling is required.

Figure 5:
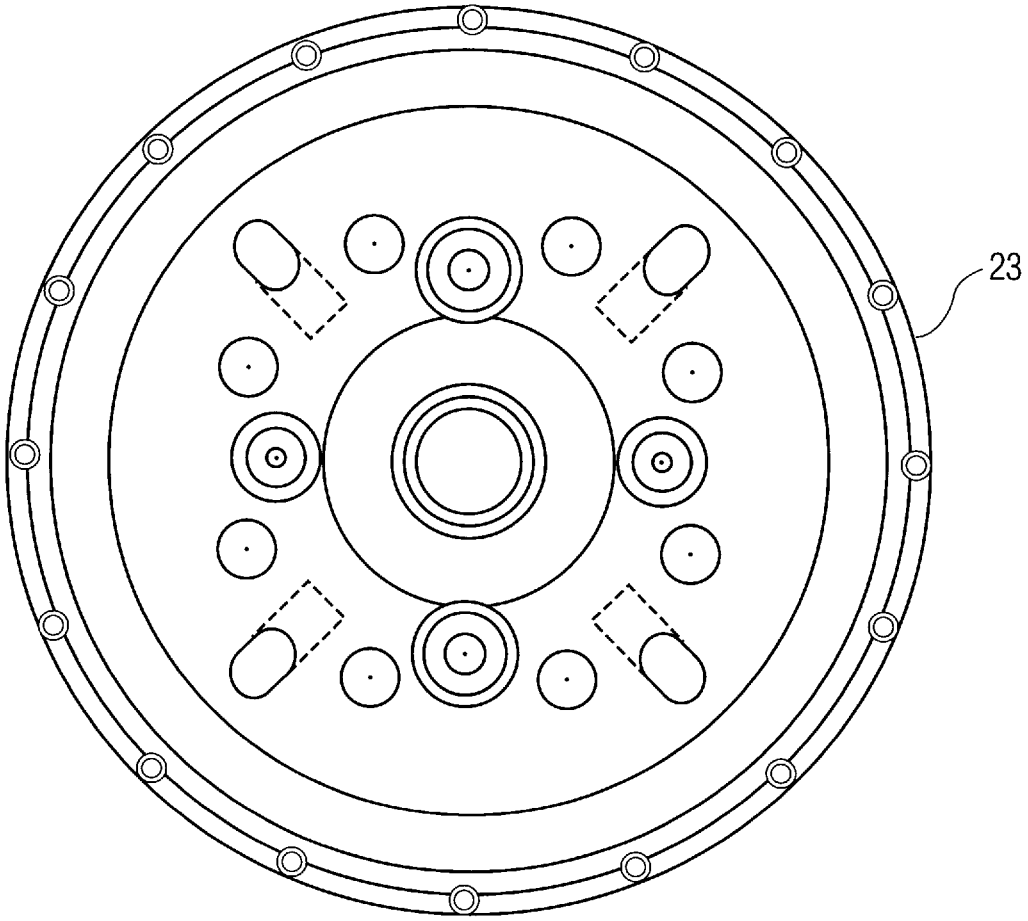
FIG. 5 is a bottom view of the bottom subassembly of the carrier of FIG. 2.
Figure 6C:
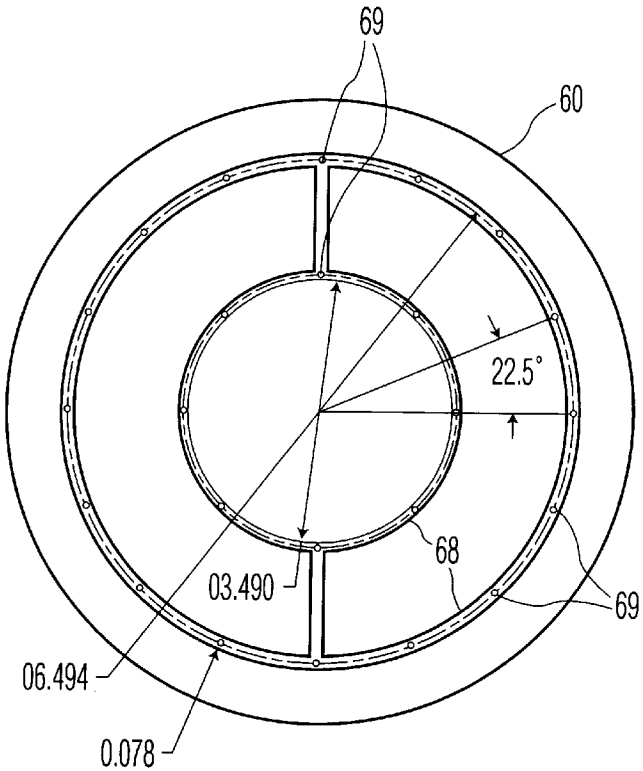
FIGS. 6A, 6B, and 6C bottom, side, and top views of portions of a vacuum supply system for holding a wafer in the carrier of FIG. 2.
Figure 6B:
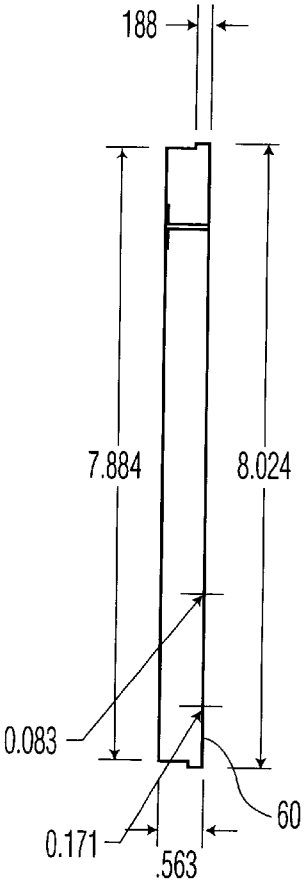
Figure 6A:
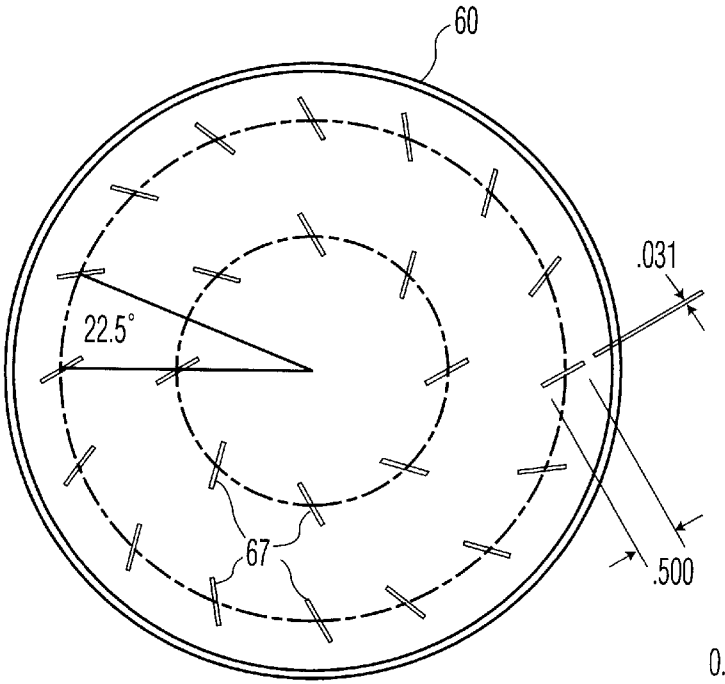

The vacuum is communicated to the bottom surface of subassembly 23 by a conduit indicated at 56 in FIG. 2. FIG. 5 is a view of the bottom of bottom subassembly 23. The vacuum is provided through a plate 60 shown in FIG. 6A. Plate 60 has a pattern of thin slots 67 in the bottom surface where each slot has a width of less than the thickness of a wafer being polished. The distribution of the vacuum in this manner ensures that the wafer will not be distorted locally (by the vacuum) into the vacuum supply conduits thus causing uneven polishing of a wafer. Plate 60 has a side view shown in FIG. 6B and a top view shown in FIG. 6C. The vacuum at the bottom of subassembly 23 is supplied through concentric circular troughs 68 in the top surface of plate 60 and supplied through conduits 69 to the slotted openings 67 shown in FIG. 6A.

Any pitch and yaw wobbling action exhibit by subassembly 23 is sensed and adjusted by an adjustment mechanism responsive to the signals representative of such movement. The pitch and yaw adjustment mechanism comprises at least three motors at 120 degrees intervals about the apparatus of FIG. 2. FIG. 2 shows one such motor 70. The motor is connected to a shaft 71 which rotates eccentric cam 72 which presses against subassembly 23. Subassembly 23 responds, as does a cam follower, to correct any pitch and yaw depending on which of the three motors is activated and the duration of that activation under a controller 73 of FIG. 2.

The shape of the opposing faces of subassemblies 22 and 23 are described herein as mating negative and positive truncated pyramids. But other shapes are possible so long as the mass of the bottom subassembly decreases with distance from the central axis (35) increases.

What is claimed is:

1. A wafer carrier for a chemical-mechanical wafer polishing apparatus, said wafer carrier comprising top, center, and bottom subassemblies mating with one another and aligned along a central axis, said center and said bottom subassemblies having bottom and top surfaces, respectively, said bottom and top surfaces having symmetrically about said central axis a negative and a positive truncated pyramidal shape, respectively, said bottom and top surfaces mating with one another, said center subassembly having an extension downward along said central axis and said bottom subassembly having a recess for receiving said extension, said extension having at a lower end thereof a ball for providing a slip fit surface for said extension in said recess in said apparatus including drive means for rotating said center and said bottom subassemblies with respect to said top subassembly.

2. A wafer carrier as in claim 1 also including pitch and yaw control means, said means comprising at least three motors mounted on said top subassembly and arranged at 120 degree positions thereabout, said bottom subassembly having at least three mating eccentric cams also located thereabout at 120 degree positions corresponding to the positions of said motors, said cams bearing against said central subassembly, said wafer carrier also including means operative responsive to pitch and yaw indications for activating said motors selectively and means responsive to motor activation for moving an associated one of said cams for adjusting the attitude of said bottom subassembly with respect to said central subassembly.

3. A wafer carrier as in claim 2 wherein said means responsive to motor activation comprises a speed reducer, each of said motors having a drive shaft connected to an associated reducer, said reducer being coupled to said eccentric cam for rotation thereof against said lower subassembly.

4. A wafer carrier as in claim 1 including a motor connected to said top subassembly, said motor being coupled to a belt, said belt being coupled to said central subassembly for rotating said central subassembly with respect to said top subassembly when activated.

5. A wafer carrier as in claim 1 wherein said top subassembly is non-rotatably connected to a positioning support.

6. A wafer carrier as in claim 5 wherein said positioning support comprises a jack having a screw thread and a worm gear for gross and fine movement and first and second motors for driving said screw thread and said worm gear selectively, said jack being connected to the top of said top subassembly along said central axis.

7. A wafer carrier as in claim 1, said wafer carrier including a positioning means attached to said top subassembly for moving said carrier up and down along said axis, said carrier including means for rotating said central and bottom subassemblies with respect to said top subassembly.

8. A wafer carrier as in claim 7 wherein said positioning means comprises a jack connected between a support arm and said top subassembly, said jack having a screw thread and a work gear for gross and fine vertical distance adjustment for applying downward movement on said carrier.

9. A wafer carrier as in claim 1 wherein said recess in said bottom subassembly provides for a space below said ball for allowing the ball to lower under pressure.

10. A wafer carrier as in claim 7 wherein said lower subassembly has a top surface which is configured to provide a mass which decreases incrementally with distance from said central axis and the bottom of said central subassembly has a geometry to mate with said top surface.

11. A wafer carrier for a chemical-mechanical wafer polishing apparatus, said wafer carrier comprising top, center, and bottom subassemblies mating with one another and aligned along a central axis, said center and bottom subassemblies having bottom and top surfaces, respectively, said top surface having a slope such that said bottom subassembly has a mass which decreases incrementally with distance from said central axis.

12. A wafer carrier as in claim 11 wherein said bottom surface has a geometry to mate with said top surface.

13. A wafer carrier as in claim 12 wherein said bottom subassembly has a recess in said top surface and said center subassembly has a downward extension extending into said recess.

* * * * *